United States Patent [19]

Crain

[11] 4,448,224

[45] May 15, 1984

[54] TUG BOAT COVER ROLLING APPARATUS

[76] Inventor: Frank M. Crain, Box 105, Shippingport, Pa.

[21] Appl. No.: 304,851

[22] Filed: Sep. 23, 1981

[51] Int. Cl.[3] ..... B63B 35/70

[52] U.S. Cl. ..... 114/242; 114/202; 114/248

[58] Field of Search ..... 114/202, 248, 249, 203, 114/253, 260

[56] References Cited

U.S. PATENT DOCUMENTS 833,058 10/1906 Kidd ..... 114/202

3,756,183 9/1973 Clemence ..... 114/249

*Primary Examiner*—Trygve M. Blix

*Assistant Examiner*—Patrick W. Young

*Attorney, Agent, or Firm*—William J. Ruano

[57] ABSTRACT

This invention relates to a cover rolling mechanism for barge covers an inverted U-shaped bar is welded to the push knees of the tugboat and the sheave is supported on top of such bar. A winch is supported nearby on the floor of the tugboat. A cable is entrained over the sheave and pulled by the winch after the end of the cable has been hooked on a double top cover of the barge, which cover, together with other covers protects the lime, or other load in the barge, from rain or other elements of weather. The cable may be reattached to other covers to affect nesting on top and bottom covers which roll along tracks on the barge. An even central pull is thus affected on the covers.

2 Claims, 11 Drawing Figures

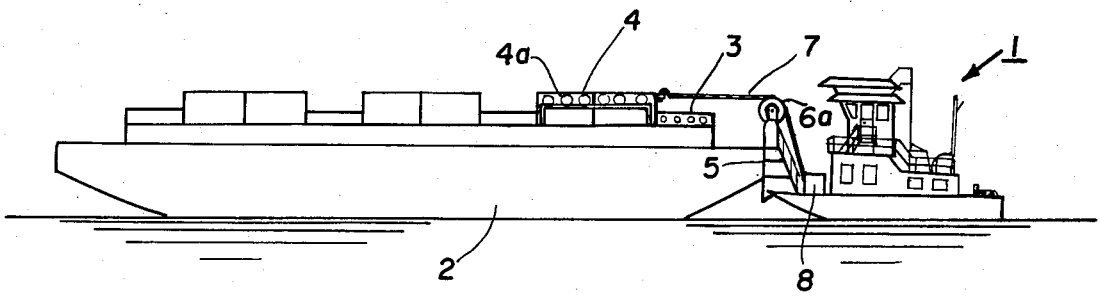
Fig. 1
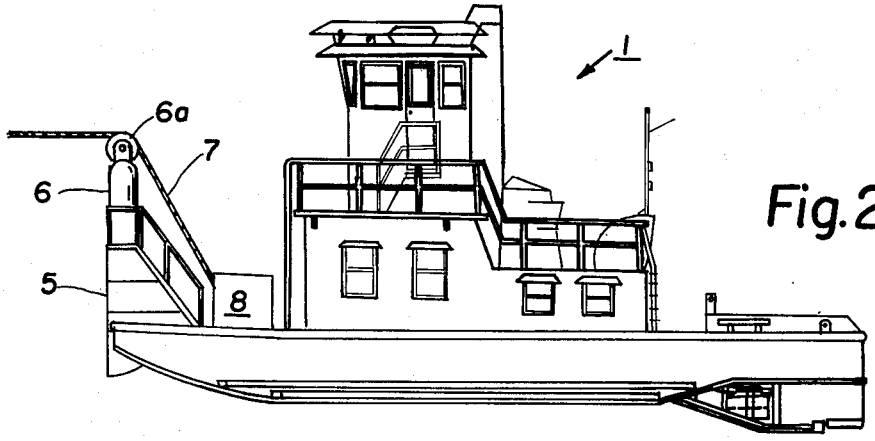
Fig. 2
Fig. 3
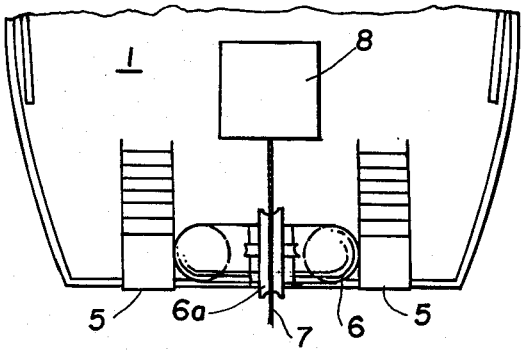
Fig. 4
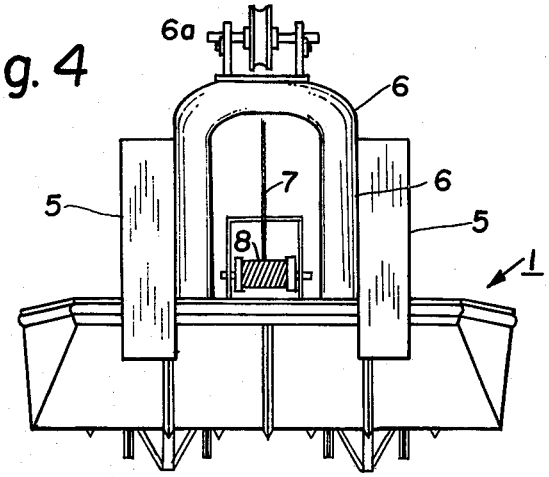
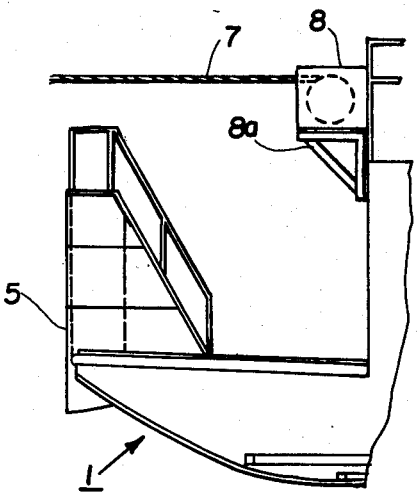
Fig. 8

TUG BOAT COVER ROLLING APPARATUS

This invention relates to a cover rolling mechanism for a hopper barge, which mechanism is mounted on the bow of a tugboat.

In the past, the cover rolling mechanism of a barge has been operated by a boat traveling alongside the barge or tugboat by tying a cable end to one of the covers and pulling by means of the boat, the cable which is disposed at an angle to the barge cover. As a consequence of the angular pull, abnormal strains have been applied to the roller or wheels for mounting the covers, causing twisted covers and binding rollers or wheels.

An object of the present invention is to provide a novel pulling assembly or cover rolling system for operating barge covers by a mechanism mounted on the tugboat.

A more specific object of the invention is to mount, on the push knees a tug boat bar for supporting a sheave along the central longitudinal axis of the barge covers so that a winch on the tugboat will exert a pull along said central axis to effect easy and untwisting pull on said covers.

Other objects and advantages of the invention will become more apparent from the following description, taken with accompanying drawings wherein;

FIG. 1 is a side view, in elevation of a hopper barge which is being pushed by a tug boat;

FIG. 2 is a side elevational view of the tug boat shown somewhat enlarged;

FIG. 3 is a top view of the tug boat shown in FIG. 2;

FIG. 4 is a front view of the tug boat shown in FIGS. 2 and 3;

Figure 9:
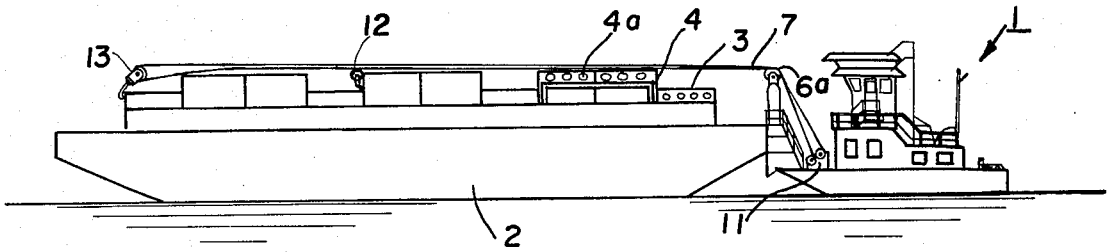
Figure 10:
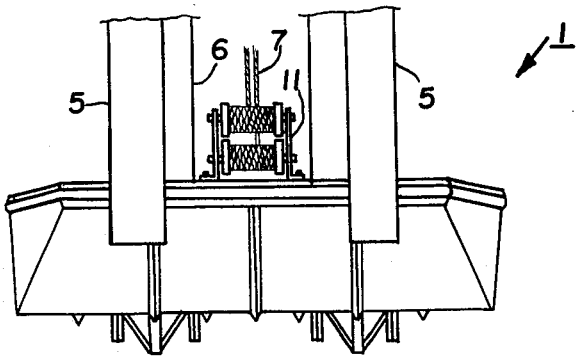
Figure 11:
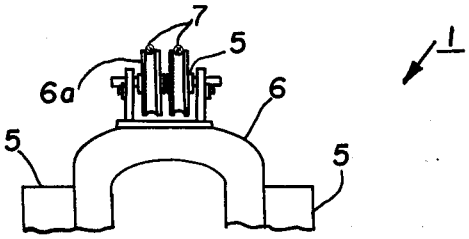

FIGS. 5, 6, 7 8 & 9 show modifications for the sheave mount. FIGS. 9–11 show a push-pull sheave.

Referring more particularly to FIG. 1 of the drawing, numeral 1 denotes the tug boat for pushing a covered hopper barge 2. A plurality of single bottom covers 3 and top covers 4 are provided to enable complete covering the tug boat or load carried by the barge, such as a pile of lime. By pulling the top covers 4 over the bottom covers 3, they will become nested and expose the contents of the hopper barge.

In accordance with the present invention, there is welded to the inner sides of the conventional push knees 5 of the tug boat an inverted U-shaped bar 6. On top of the curved central portion thereof, there is mounted a sheave 6*a* which entrains a cable 7 which is pulled by a winch 8. The sheave is substantially on the level of the covers. The free end of cable 7 is hooked onto a double top cover 4 of the barge so that when the winch 8 is operated, aided by controls at the winch or in the pilot house, the cover will ride on wheels or carriages along the sides of the top and bottom cover for the purpose of more easily sliding the covers into and out of nesting relationship.

In operation, therefore, the free end of the cable 7 is selectively attached to an eye secured to the top central portion of each cover to enable any longitudinal portion of the contents of the barge to be covered and protected from the elements, and since the pull is along the central longitudinal axis of both the tug boat ad the barge, there will be no twisting tendency of the covers that might result in damage to the covers or their carriages.

Figure 5:
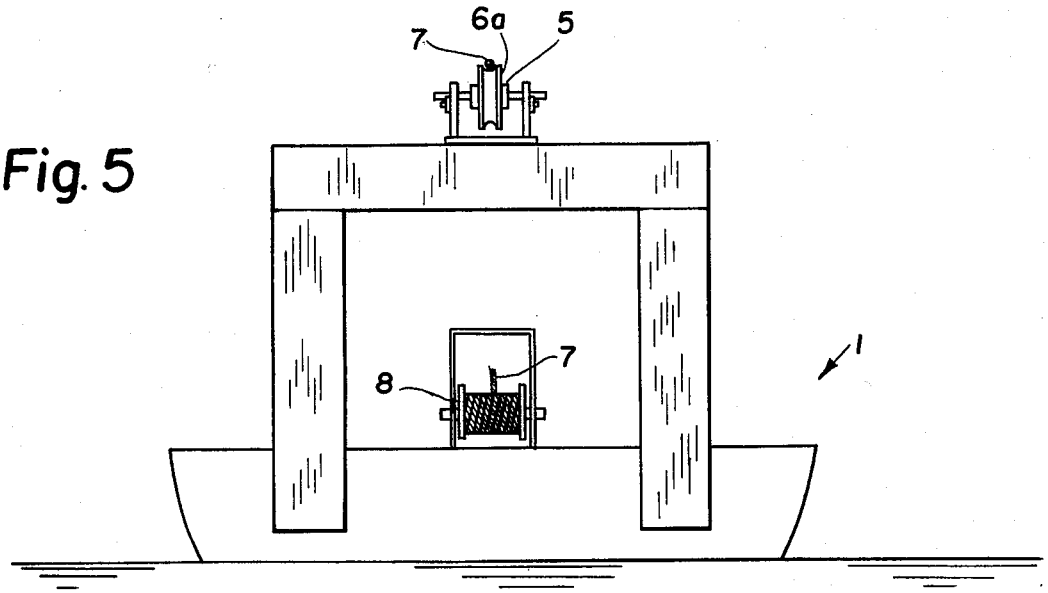

FIG. 5 shows a modification involving a straight bar forming a bridge over the top ends of the push knees and welded thereto.

Figure 6:
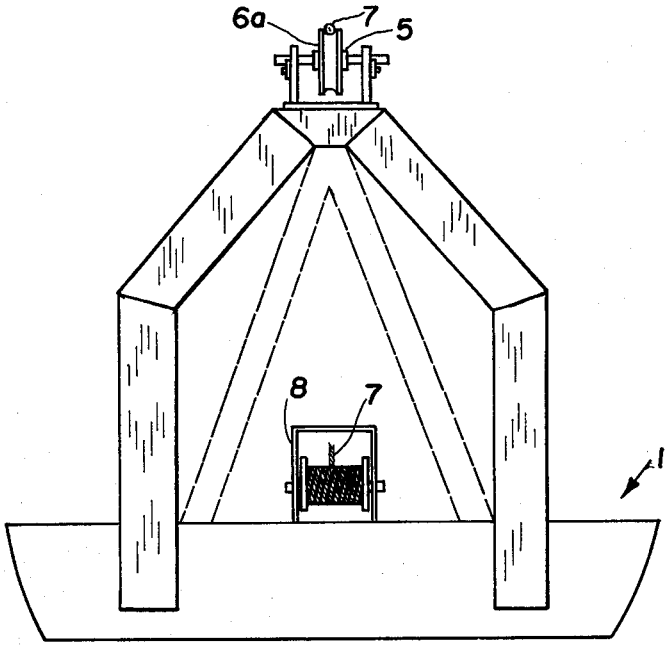

FIG. 6 shows a further modification involving a triangular bar supported on the top and welded to the top ends of the push knees.

Figure 7:
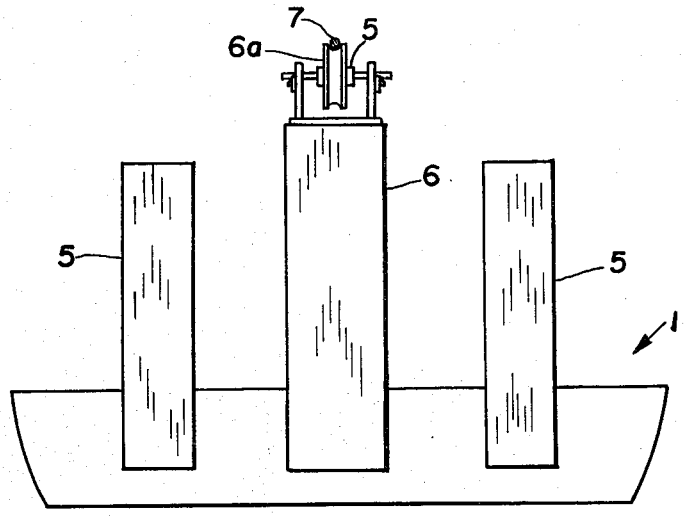

FIG. 7 shows a still further modification comprising a single divided post centrally of the push knees and on top of which the sheave is mounted.

FIG. 8 shows a direct connection to the covers eliminating the sheave or support thereof.

FIGS. 9–11 show a modification which is particularly suitable for either pulling or pushing the covers along the tracks of the barge. For example, in some instances the barge is loaded more heavily in the end being pushed, tending to tilt the barge longitudinaly and to slide the covers by gravity towards the end being pushed and thereby uncovering the load. In order to enable the covers to be moved away from the direction of contact with the tugboat so as to cover the load, a continuous or closed pulley system 6a-11 is shown in FIG. 9 which enables selective pushing or pulling of the covers along a longitudinal center-line of the barge. This provides flexibility in operation of the covers under any circumstances of tilt by virtue of uneven loading of the barge.

Thus it will be seen that I have provided an efficient and easily operable and controllable mechanism for sliding the covers of a barge into or out of nesting relationship to enable uncovering or covering of lime or other load materials in the barge; furthermore, I have provided means for pulling the cable from a tug boat along the longitudinal central axis of the tug boat to avoid any twisting pulls on the covers that might damage the covers or their carriage structure; furthermore I have provided a bridge over the push knees having a dual function of reinforcing the push knees as well as providing a support for a sheave so that it will pull in alignment with the longitudinal central axis of the tug boat.

While I have illustrated and described several embodiments of my invention, it will be understood that these are by way of illustration only and that various changes and modifications may be contemplated in my invention and within the scope of the following claims.

I claim:

1. In combination with a tow boat having a pair of vertically extending push knees at the bow of the boat and a barge pushed by said push knees and which barge has a plurality of slidable top and bottom covers which are slidable into and out of nesting relationship, the improvement comprising a bar, bridging the top ends of said push knees, mounting a sheave centrally of the bow of said tow boat and positioned substantially at the height of said covers, a winch mounted centrally in the bow portion of said tug boat for pulling on a cable entrained about said sheave and having a free end connected to one of said covers, said sheave being mounted on top of said bar and being at a height substantially that of said covers, whereby the winch will selectively pull said covers along a central longitudinal axis to prevent twisting movements of said covers.

2. Apparatus as recited in claim 1 wherein said bar is of substantially inverted U-shape with outer sides directly welded to the confronting faces of said push knees.

* * * * *